US011832360B1

(12) United States Patent
Wu et al.

(10) Patent No.: US 11,832,360 B1
(45) Date of Patent: Nov. 28, 2023

(54) LAMP DEVICE AND LIGHT-EMITTING CONTROL METHOD THEREOF

(71) Applicant: LEOTEK CORPORATION, Taipei (TW)

(72) Inventors: Wei-Ting Wu, Taipei (TW); Jhao-Tian Pan, Taipei (TW); Yao-Chi Peng, Taipei (TW); Chung-Hsiang Chang, Taipei (TW)

(73) Assignee: LEOTEK CORPORATION, Taipei (TW)

( * ) Notice: Subject to any disclaimer, the term of this patent is extended or adjusted under 35 U.S.C. 154(b) by 0 days.

(21) Appl. No.: 17/968,840

(22) Filed: Oct. 19, 2022

(51) Int. Cl.
*H05B 45/24* (2020.01)
*H05B 45/325* (2020.01)

(52) U.S. Cl.
CPC ..... *H05B 45/24* (2020.01); *H05B 45/325* (2020.01)

(58) Field of Classification Search
CPC ..... H05B 45/10; H05B 45/14; H05B 45/24; H05B 45/325; H05B 47/10
See application file for complete search history.

(56) References Cited

U.S. PATENT DOCUMENTS 11,076,458 B2 7/2021 Tu et al.
2015/0326117 A1* 11/2015 Tischler ..... H05B 45/10 315/185 R
2016/0323949 A1* 11/2016 Lee ..... H05B 45/385
2021/0059024 A1 2/2021 Tu et al.

FOREIGN PATENT DOCUMENTS

CN 113973411 A 1/2022
TW 201135123 A 10/2011
TW I703895 B 9/2020
TW 202110274 A 3/2021

OTHER PUBLICATIONS

Taiwan Office Action corresponding to Application No. 111126272 dated Jul. 14, 2023, 7 pages.

* cited by examiner

*Primary Examiner* — Jimmy T Vu
(74) *Attorney, Agent, or Firm* — Innovation Counsel LLP

(57) ABSTRACT

A lamp device includes a controller, a plurality of light-emitting elements, a plurality of current conversion modules and an interpretation module. The controller is configured to output a dimming signal. The current conversion modules are coupled to the light-emitting elements and configured to control the light-emitting elements to emit light. The interpretation module is coupled to the current conversion modules and configured to output, according to a comparison table, a plurality of control signals corresponding to the dimming signal to the current conversion modules respectively. The light-emitting elements are different in a luminous property, and one of the current conversion modules is configured to output a feedback signal to the controller.

14 Claims, 3 Drawing Sheets

LAMP DEVICE AND LIGHT-EMITTING CONTROL METHOD THEREOF

This application claims the benefit of People's Republic of China application Serial No. 202210826567.9, filed Jul. 13, 2022, the subject matter of which is incorporated herein by reference.

TECHNICAL FIELD

The disclosure relates in general to a lamp device and a light-emitting control method thereof.

BACKGROUND

Medium-high color temperature light emitted by conventional road lamp has better luminous efficiency, but low penetration rate in rainy days, which leads to serious light exposure. Although the low color temperature light emitted by conventional road lamp has better the penetration rate in rainy days, but the low luminous efficiency. Therefore, the road lamp how to emit appropriate light in response to changes in the environment is one of the directions of the industry in the technical field.

SUMMARY

According to an embodiment, a lamp device is provided. The lamp device includes a controller, a plurality of light-emitting elements, a plurality of current conversion modules and an interpretation module. The controller is configured to output a dimming signal. The current conversion modules are coupled to the light-emitting elements and configured to control the light-emitting elements to emit light. The interpretation module is coupled to the current conversion modules and configured to output, according to a comparison table, a plurality of control signals corresponding to the dimming signal to the current conversion modules respectively. The light-emitting elements are different in a luminous property, and one of the current conversion modules is configured to output a feedback signal to the controller.

According to another embodiment, a light-emitting control method for a lamp device is provided. The light-emitting control method includes the following steps: outputting a dimming signal by a controller; outputting, according to a comparison table, a plurality of control signals corresponding to the dimming signal to the current conversion modules respectively by an interpretation module, wherein the light-emitting elements are different in a luminous property; controlling the corresponding light-emitting element to emit light according to the corresponding control signal by each current conversion module; and outputting a feedback signal to the controller by one of the current conversion modules.

The above and other aspects of the disclosure will become better understood with regard to the following detailed description of the preferred but non-limiting embodiment (s). The following description is made with reference to the accompanying drawings.

Figure 1:
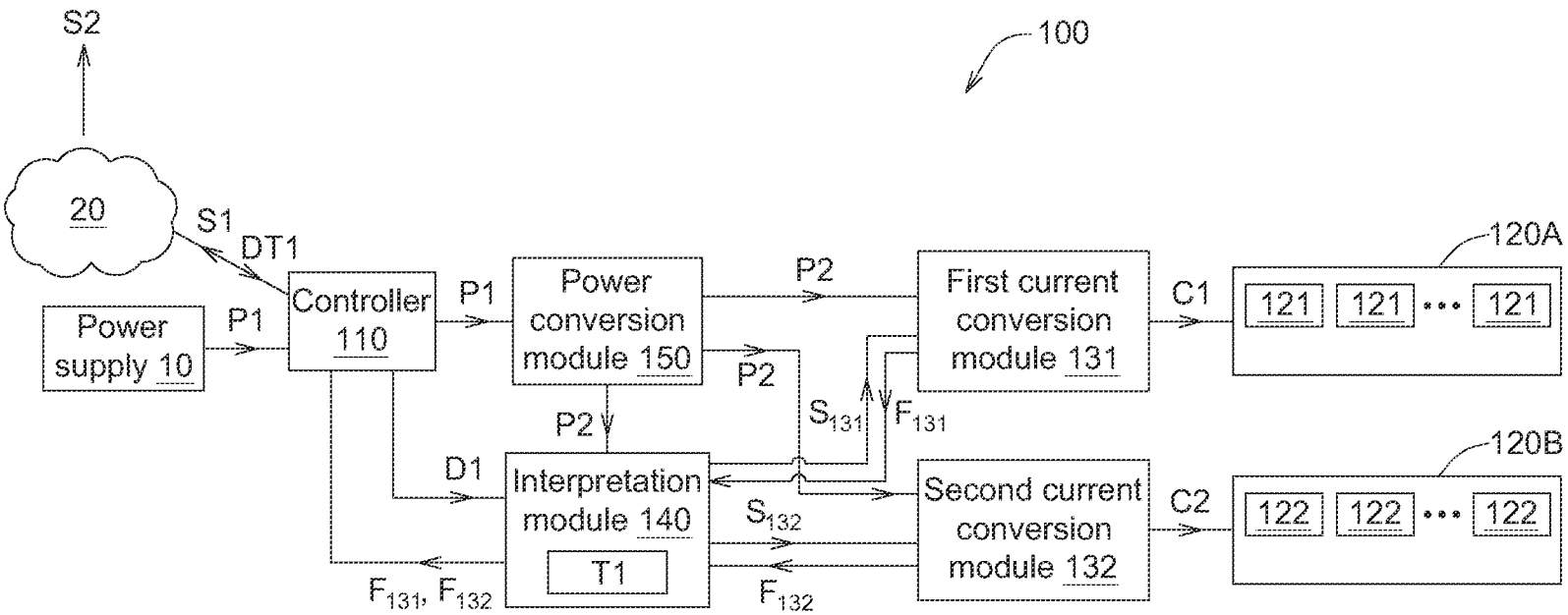
FIG. 1 shows a functional block diagram of a lamp device according to an embodiment of the present invention.

In the following detailed description, for purposes of explanation, numerous specific details are set forth in order to provide a thorough understanding of the disclosed embodiments. It will be apparent, however, that one or more embodiments could be practiced without these specific details. In other instances, well-known structures and devices are schematically shown in order to simplify the drawing.

DETAILED DESCRIPTION

Referring to FIG. 1, FIG. 1 shows a functional block diagram of a lamp device 100 according to an embodiment of the present invention. The lamp device 100 of the present embodiment is, for example, a road lamp, a searchlight, a stadium lamp or other type of light-emitting device. The lamp device 100 could be disposed on various places that need illumination, such as road, suburb, stadium, sea, etc.

The lamp device 100 includes a controller 110, a number of light-emitting elements (for example, at least one first light-emitting element 121 and at least one second light-emitting element 122), a number of current conversion modules (for example, a first current conversion module 131 and a second current conversion module 132) and an interpretation module 140. These light-emitting elements are different in light-emitting characteristics. The controller 110 is configured for outputting a dimming signal D1. Each current conversion module is coupled to at least one light-emitting element and configured to control the light-emitting element to emit light. The interpretation module 140 is coupled to the current conversion modules and configured for outputting a number of control signals (for example, a first control signal $S_{131}$ and a second control signal $S_{132}$) corresponding to the dimming signal D1 according to a comparison table T1, respectively to the current conversion modules. As a result, through the combination of a number of the light-emitting elements having different luminous properties, a number of illuminations having a number of different light-emitting modes could be obtained, so as to respond to a variety of or changeable external environmental conditions.

Furthermore, the lamp device 100 further includes at least one sensor (not shown), and the sensor is electrically coupled to the controller 110. The sensor could detect external environmental state. The external environment state is, for example, weather (for example, rainy, sunny, cloudy, foggy, etc.), time period (for example, day, night, etc.), or road condition (for example, water logging).

In the present embodiment, the controller 110 is, for example, a smart controller of a road lamp, which is, for example, a physical circuit formed by a semiconductor process. The controller 110 outputs the corresponding dimming signal D1 to the interpretation module 140 according to the external environment state. In another embodiment, a cloud server 20 could send a dimming command DT1 to the controller 110, and the controller 110 outputs the corresponding dimming signal D1 to the interpretation module 140 according to the dimming command DT1. The interpretation module 140 could output, according to the comparison table T1, a first control signal $S_{131}$ and a second control signal $S_{132}$ corresponding to the dimming signal D1 to the first current conversion module 131 and the second current conversion module 132 respectively. The current conversion module 131 outputs a first direct current C1 corresponding to the first control signal $S_{131}$ to the first light-emitting element 121, and the second current conversion module 132 outputs a second direct current C2 corresponding to the second control signal $S_{132}$ to the second light-emitting element 122. The first light-emitting element 121 and the second light-emitting element 122 emit the illumination corresponding to the external environment state. The first control signal $S_{131}$ and the second control signal $S_{132}$ are, for example, pulse-width modulation (PWM) signals.

As shown in FIG. 1, the first light-emitting element 121 and the second light-emitting element 122 are, for example, light-emitting diodes, laser diodes or other light-emitting elements suitable for the lamp device 100. The first light-emitting element 121 and the second light-emitting element 122 are different in luminous properties. Although the number of the light-emitting element having the same luminous property is one as an example, in other embodiments, the number of the light-emitting element having the same luminous property could be two or more. The first light-emitting element 121 and the second light-emitting element 122 are different in color temperature. In an embodiment, the color temperature of the emitting-light of the first light-emitting element 121 is higher than the color temperature of the emitting-light of the second light-emitting element 122. Specifically, the first light-emitting element 121 could emit the light having, for example, a medium-high color temperature, and the second light-emitting element 122 could emit the light having, for example, a low-color temperature. The aforementioned "medium-high color temperature" ranges, for example, between 4000 K and 10000 K, and the "low color temperature" ranges, for example, between 1000 K to 4000 K; however, such exemplification is not meant to be for limiting.

As shown in FIG. 1, the lamp device 100 further includes at least one lamp board, and each lamp board could carry at least one light-emitting element or at least two light-emitting elements having the same or different luminous properties. For example, the lamp device 100 further includes a first lamp board 120A and a second lamp board 120B, wherein at least one first light-emitting element 121 having the same luminous property could be disposed on the first lamp board 120A, and at least one second light-emitting element 122 having the same luminous property could be disposed on the second lamp board 120B. Each lamp board could be coupled to the corresponding current conversion module for being controlled by the corresponding current conversion module. For example, the first lamp board 120A is coupled to the first current conversion module 131, while the second lamp board 1208 is coupled to the second current conversion module 132.

As shown in FIG. 1, each current conversion module (each of the first current conversion module 131 and the second current conversion module 132) is, for example, a physical circuit formed by at least one semiconductor process, and configured for outputting, according to corresponding control signal, a direct current (DC) to the corresponding light-emitting element (or lamp board), wherein the direct current depends on comparison table T1. For example, the first current conversion module 131 outputs the first direct current C1 to the first light-emitting element 121 according to the first control signal $S_{131}$, and the first light-emitting element 121 emits light by the driving of the first direct current C1. The second current conversion module 132 outputs the second direct current C2 to the second light-emitting element 122 according to the second control signal $S_{132}$, and the second light-emitting element 122 emits light by the driving of the second direct current C2. In addition, the number of the current conversion modules is equal to the type of luminous properties of the light-emitting elements, and each current conversion module is coupled to at least one light-emitting element having the same luminous property.

Each current conversion module outputs, according to the corresponding control signal, the direct current to the corresponding lamp board for controlling the light-emitting elements disposed on the corresponding lamp board to emit light. For example, the first current conversion module 131 outputs, according to the first control signal $S_{131}$, the first direct current C1 to the first lamp board 120A for controlling the first light-emitting elements 121 disposed on the first lamp board 120A to emit light, and the second current conversion modules 132 outputs, according to the second control signal $S_{132}$, the second direct current C2 to the second lamp board 1208 for controlling the second light-emitting elements 122 disposed on the second lamp board 120B to emit light.

The interpretation module 140 is, for example, a physical circuit formed by at least one semiconductor process, or could be software or firmware. The interpretation module 140 could be integrated into the controller 110 or another controller or processor. The interpretation module 140 could store the comparison table T1. In an embodiment, the interpretation module 140 is configure for: (1) comparing the dimming signal D1 according to the comparison table; and (2). outputting the control signal corresponding to the dimming signal D1 to the corresponding light-emitting element, without performing the voltage dividing and/or the current dividing, and/or without processing the dimming signal D1; however, such exemplification is not meant to be for limiting.

As shown in FIG. 1, the lamp device 100 further includes a power conversion module 150. The power conversion module 150 is, for example, an AC-to-DC transformer. The AC-to-DC transformer has the advantages of being cheap, stable, mature development, high conversion efficiency, etc. The AC-to-DC transformer could be disposed in a front stage of the circuit of the power conversion module 150 and the interpretation module 140, and accordingly it could effectively prevent the power conversion module 150 and the interpretation module 140 from being damaged by a surge. The power conversion module 150 is coupled to the current conversion modules and the interpretation modules 140 and is configured for supplying power to the current conversion modules and the interpretation modules 140. For example, a power supply 10 is coupled to the controller 110 and outputs the alternating current P1 to the controller 110. The controller 110 transmits the alternating current P1 to the power conversion module 150, and the power conversion module 150 converts the alternating current P1 into the direct current P2, and provides each current conversion module and the interpretation module 140 with the required DC power P2 according to the requirement of each current conversion module and the interpretation module 140, wherein the DC power P2 required by each current conversion module and the interpretation module 140 may be the identical or different.

The relationship among the dimming signal D1, the first control signal $S_{131}$ and the second control signal $S_{132}$ Is described below.

As shown in Table 1 below, it lists the relationship among the dimming signal D1, the first control signal $S_{131}$ and the second control signal $S_{132}$ (the comparison table T1). The comparison table T1 could be obtained in advance through experiments, simulations, etc., and then stored in the interpretation module 140 or in a storage (for example, a memory) coupled to the interpretation module 140. The comparison table T1 shown in Table 1 is only as an example, and it is not intended to limit the embodiments of the present invention. It could be seen from Table 1 that the values of a number of the control signals in the embodiment of the present invention could be equal or different. For example, the control signals are all equal to 0. Alternatively, one of the control signals is equal to 0, and another of the control signals is not equal to 0. In another embodiment, the values of the control signals could be greater than 0 and equal. In other embodiments, the values of the control signals could not be equal to 0. The numerical value and/or proportional relationship of the control signals could depend on the external environment state, which is not limited in the embodiment of the present invention.

TABLE 1

(comparison table T1)

| dimming signal D1 (volt, V) | first control signal $S_{131}$ | second control signal $S_{132}$ |
|---|---|---|
| 0 | 0% | 0% |
| 1 | 0% | 0% |
| 2 | 0% | 0% |
| 3 | 0% | 0% |
| 4 | 80% | 0% |
| 5 | 90% | 0% |
| 6 | 100% | 0% |
| 7 | 100% | 0% |
| 8 | 0% | 80% |
| 9 | 0% | 90% |
| 10 | 0% | 100% |

Assuming that the dimming signal D1 is 4 volts (Volt, V), the interpretation module 140 outputs the first control signal $S_{131}$ representing 80% of 4V to the first light-emitting element 121 according to the comparison table T1 and outputs the second control signal $S_{132}$ representing 0% of 4V to the second light-emitting element 122. The first light-emitting element 121 emits light according to the first control signal $S_{131}$ and the second light-emitting element 122 emits light according to the second control signal $S_{132}$, wherein the emitting-light of the first light-emitting element 121 and the emitting-light of the second light-emitting element 122 or their mixed emitting-light could match the external environment state. For example, on a non-rainy day, the lamp device 100 could emit light with medium-high color temperature, which has better luminous efficiency and is easy for driver to concentrate and recognize near and far objects (for example, object shapes). In rainy days, the lamp device 100 could emit light with low color temperature, which has good penetration rate for rain and fog, is not easy to form glare and is conducive to improving driving safety. In an embodiment, during heavy traffic hours, the lamp device 100 could emit light with medium-high color temperature to refresh the driver and help the driver recognize near and far objects (for example, object shapes). In the late night period, the lamp device 100 could emit light with low color temperature to reduce the impact of illumination on human eyes, the environment and/or ecology, and further achieve the purpose of the friendly environment. During the rain and fog period, the lamp device 100 could emit light with low color temperature to improve the penetration rate for rain and fog, and further reduce the occurrence of light exposure.

In addition, the lamp device 100 could further provide abnormality determination information for the controller 110 or the cloud server 20 to determine the abnormality cause, and it will be further described below.

As shown in FIG. 1, one, any or each of the current conversion modules could output a number of feedback signals (a first feedback signal $F_{131}$ and a second feedback signal $F_{132}$) to the controller 110. For example, the first current conversion module 131 could output the first feedback signal $F_{131}$ to the controller 110, and the second current conversion module 132 could output the second feedback signal $F_{132}$ to the controller 110. In addition, the feedback signal is transmitted to the controller 110 through, for example, the interpretation module 140; however, such exemplification is not meant to be for limiting, and the feedback signal could also be directly transmitted to the controller 110. The feedback signal could carry relevant data of the current input/output of the current conversion module. For example, the first feedback signal $F_{131}$ represents, for example, the current and/or voltage actually output by the first current conversion module 131 to the first light-emitting element 121, and the second feedback signal $F_{132}$ represents, for example, the current and/or voltage actually output by the second current conversion module 132 to the second light-emitting element 122. The first current conversion module 131 further includes a detection circuit (not shown) which could detect the current and/or voltage output to the first light-emitting element 121. Similarly, the second current conversion module 132 further includes a detection circuit (not shown) which could detect the current and/or voltage output to the second light-emitting element 122.

The controller 110 is further configured to determine whether the feedback signals (the first feedback signal $F_{131}$ and the second feedback signal $F_{132}$) are in the abnormal range, and generate an abnormal notification signal S1 according to on the feedback signals that is in the abnormal range. The controller 110 could transmit the abnormal notification signal S1 to the cloud server 20, and the cloud server 20 accordingly determines the abnormal cause. In another embodiment, the feedback signals (the first feedback signal $F_{131}$ and the second feedback signal $F_{132}$) could be transmitted to the cloud server 20 by the controller 110, and the cloud server 20 accordingly determines whether the feedback signals are in the abnormal range.

The following table 2 lists the values of the feedback signals (the first feedback signal $F_{131}$ and the second feedback signal $F_{132}$) indicating that the actual output voltage and the actual output current of the current conversion module are within the normal range and the abnormal range. Table 2 could be obtained in advance through experiments, simulations, etc., and then stored in the controller 110 or the cloud server 20.

TABLE 2

| | actual output of the power supply 10 | | feedback signal of the current conversion module | |
|---|---|---|---|---|
| determination mode | actual output voltage (V) of the power supply 10 | actual output current (A) of the power supply 10 | actual output voltage (V) of the current conversion module | actual output current (A) of the current conversion module |
| normal range | 200 to 240 | 0.65 to .7 | 65 to 81 | 1.85 to 2.3 |
| abnormal range | Lower than 220 or higher than 240 | Lower than 0.65 or higher than 0.7 | Lower than 65 or higher than 81 | Lower than 1.85 or higher than 2.3 |

As shown in Table 2, for the feedback signal representing the actual output voltage of the current conversion module, the normal range is, for example, a voltage range of 65V to 81V, and a range beyond the voltage range is the abnormal range. For the feedback signal representing the actual output current of the current conversion module, the normal range is, for example, a current range between 1.85 ampere (A) and 2.3 A, and a range beyond the current range is the abnormal range.

When the actual output voltage (feedback signal) of the current conversion module is in the abnormal range and/or the actual output current (feedback signal) of the current conversion module is in the abnormal range, the controller 110 generates the corresponding abnormal notification signal S1, The abnormal notification signal S1 is transmitted to the cloud server 20, and the cloud server 20 accordingly determines the abnormal cause.

The following table 3 lists a number of the abnormal causes corresponding to, under the abnormal state, the actual output voltage of the power supply 10, the actual output current of the power supply 10, the actual output voltage of the current conversion module and/or the actual output current of the current conversion module. Table 3 could be obtained in advance through experiments, simulations, etc., and then stored in the controller 110 or the cloud server 20.

TABLE 3

| abnormal cause | actual output voltage (V) of the power supply 10 | actual output current (A) of the power supply 10 | actual output voltage (V) of the current conversion module | actual output current (A) of the current conversion module |
|---|---|---|---|---|
| power supply system is abnormal | abnormal | abnormal | abnormal | abnormal |
| the relay of the controller 110 is turned off | normal | abnormal | abnormal | abnormal |
| the power conversion module 150 is damaged by the surge | normal | abnormal | abnormal | abnormal |
| the light board is shorting | normal | normal | abnormal | normal |
| the light board is damaged | normal | normal | normal | abnormal |

The cloud server 20 could query the abnormal cause corresponding to the abnormal notification signal S1 according to Table 3. For example, when the abnormality notification signal S1 represents that the actual output voltage of the current conversion module and the actual output current of the current conversion module both are abnormal, the cloud server 20 could output an abnormality signal S2 representing "the power supply system is abnormal" according to Table 3. The abnormal signal S2 is, for example, text, which could be displayed on a display screen (not shown) connected to the cloud server 20. Alternatively, the abnormal signal S2 is, for example, vibration, which could be generated by a vibrator (not shown) connected to the cloud server 20. Alternatively, the abnormal signal S2 is, for example, sound, which could be emitted by a speaker (not shown) connected to the cloud server 20.

In the present embodiment, the abnormality determination is based on the actual output voltage and/or the actual output current of the current conversion module. In another embodiment, the abnormality determination is also based on the actual output voltage and/or the actual output current of the power supply 10.

As shown in Table 2 above, Table 2 further lists the values of the feedback signals (the first feedback signal $F_{131}$ and the second feedback signal $F_{132}$) indicating that the actual output voltage and the actual output current of the current conversion module are within the normal range and the abnormal range. For the actual output voltage of the power supply 10, the normal range is, for example, a voltage range of 200 V to 240 V, and a range beyond the voltage range is the abnormal range. For the actual output current of the power supply 10, the normal range is, for example, a current range between 0.65 A and 0.7 A, and a range beyond the current range is the abnormal range.

As shown in FIG. 1, the controller 110 is further configured to determine whether the alternating current P1 provided by the power supply 10 is in the abnormal range, and generate the abnormal notification signal S1 based on the alternating current P1 being in the abnormal range. For example, the controller 110 further includes a detection circuit (not shown) which could detect the actual voltage and/or the actual current of the alternating current P1 provided by the power supply 10, the controller 110 determines whether the actual voltage and/or the actual current of the detected alternating current P1 is in the abnormal range, and the controller 110 generates the corresponding abnormal notification signal S1 based on the actual voltage and/or the actual current of the detected alternating current P1 being in the abnormal range and accordingly outputs the abnormal notification signal S1 to the cloud server 20. In another embodiment, the actual voltage information and/or the actual current information of the alternating current P1 could be transmitted, by the controller 110, to the cloud server 20, and the cloud server 20 determines whether the actual voltage information and/or the actual current information of the alternating current P1 is in the abnormal range.

The cloud server 20 could query the abnormal cause corresponding to the abnormal notification signal S1 according to Table 3. For example, when the abnormality notification signal S1 represents that the actual output voltage of the power supply 10, the actual output current of the power supply 10, the actual output voltage of the current conversion module and the actual output current of the current conversion module all are abnormal, the cloud server 20 could output an abnormality signal S2 representing "the power supply system is abnormal" according to Table 3.

Figure 2:
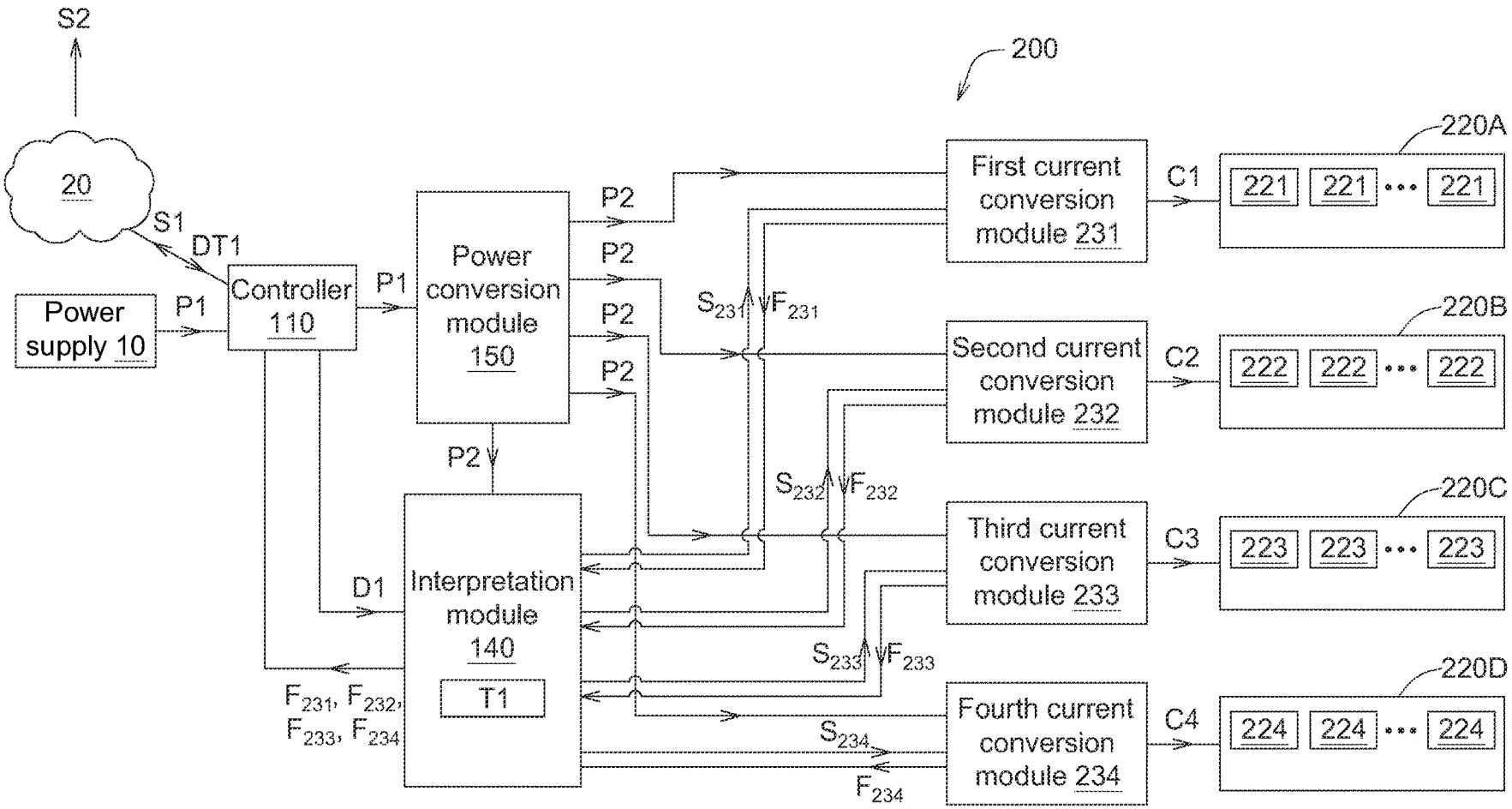
FIG. 2 shows a functional block diagram of a lamp device according to another embodiment of the present invention.

Referring to FIG. 2, FIG. 2 shows a functional block diagram of a lamp device 200 according to another embodiment of the present invention. The lamp device 200 of the present embodiment is, for example, a road lamp, a searchlight, a stadium lamp or other type of light-emitting device.

As shown in FIG. 2, the lamp device 200 includes the controller 110, a number of the light-emitting elements (for example, at least one first light-emitting element 221, at least one second light-emitting element 222, at least one third light-emitting element 223 and at least one fourth light-emitting element 223), a number of the current conversion modules (for example, a first current conversion module 231, a second current conversion module 232, a third current conversion module 233 and a fourth current conversion module 234), the interpretation module 140 and the power conversion module 150. The lamp device 200 includes the technical features similar to or the same as that of the lamp device 100, except that the light-emitting elements of the lamp device 200 are not only different in color temperature, but also different in light pattern.

In other embodiments, a number of the light-emitting elements could be different in N (inclusive) or more luminous properties, wherein N is, for example, a positive integer equal to or greater than 3. Correspondingly, the number of the current conversion modules is, for example, N, and each current conversion module could be coupled to the light-emitting element(s) having the same luminous property.

As shown in FIG. 2, the controller 110 outputs the dimming signal D1 to the interpretation module 140 according to the external environment state. The interpretation module 140 could output, according to the comparison table T1, the first control signal $S_{231}$, the second control signal $S_{232}$, the third control signal $S_{233}$ and the fourth control signal $S_{234}$ corresponding to the dimming signal D1 to the first current conversion module 231, the second current conversion module 232, the third current conversion module 233 and the fourth current conversion module 234 respectively. The first current conversion module 231 outputs the first direct current C1 corresponding to the first control signal $S_{231}$ to the first light-emitting element 221, the second current conversion module 232 outputs the second direct current C2 corresponding to the second control signal $S_{232}$ to the second light-emitting element 222, the third current conversion module 233 outputs a third direct current C3 corresponding to the third control signal $S_{233}$ to the third light-emitting element 223, and the fourth current conversion module 234 outputs a fourth direct current C4 corresponding to the fourth control signal $S_{234}$ to the fourth light-emitting element 224. The first light-emitting element 221, the second light-emitting element 222, the third light-emitting element 223 and the fourth light-emitting element 224 emit corresponding light according to the external environment state. The first control signal $S_{231}$, the second control signal $S_{232}$, the third control signal $S_{233}$ and the fourth control signal $S_{234}$ are, for example, pulse-width modulation.

Table 4 lists the relationship among the dimming signal D1, the first control signal $S_{231}$, the second control signal $S_{232}$, the third control signal $S_{233}$ and the fourth control signal $S_{234}$ (comparison table T2). Table 4 is merely an example, and the comparison table of the embodiments of the present invention is not limited by Table 4. The comparison table T2 could be obtained in advance through experiments, simulations, etc., and then stored in the interpretation module 140 or the storage (for example, a memory) connected with the interpretation module 140. The comparison table T2 in Table 4 is merely an example, and such exemplification is not meant to be for limiting.

TABLE 4

(comparison table T1)

| the dimming signal D1 (V) | the first control signal $S_{231}$ | the second control signal $S_{232}$ | the third control signal $S_{233}$ | the fourth control signal $S_{234}$ |
|---|---|---|---|---|
| 0 to 0.5 | 0% | 0% | 0% | 0% |
| 0.51 to 1 | 30% | 0% | 0% | 0% |
| 1.01 to 1.5 | 50% | 0% | 0% | 0% |
| 1.51 to 2 | 80% | 0% | 0% | 0% |
| 2.01 to 2.5 | 100% | 0% | 0% | 0% |
| 2.51 to 3 | 70% | 30% | 0% | 0% |
| 3.01 to 3.5 | 0% | 30% | 0% | 0% |
| 3.51 to 4 | 0% | 50% | 0% | 0% |
| 4.01 to 4.5 | 0% | 80% | 0% | 0% |
| 4.51 to 5 | 0% | 100% | 0% | 0% |
| 5.01 to 5.5 | 0% | 70% | 0% | 30% |
| 5.51 to 6 | 0% | 0% | 0% | 30% |
| 6.01 to 6.5 | 0% | 0% | 0% | 50% |

TABLE 4-continued (comparison table T1)

| the dimming signal D1 (V) | the first control signal $S_{231}$ | the second control signal $S_{232}$ | the third control signal $S_{233}$ | the fourth control signal $S_{234}$ |
|---|---|---|---|---|
| 6.51 to 7 | 0% | 0% | 0% | 80% |
| 7.01 to 7.5 | 0% | 0% | 0% | 100% |
| 7.51 to 8 | 0% | 0% | 30% | 70% |
| 8.01 to 8.5 | 0% | 0% | 30% | 0% |
| 8.51 to 9 | 0% | 0% | 50% | 0% |
| 9.01 to 9.5 | 0% | 0% | 80% | 0% |
| 9.51 to 10 | 0% | 0% | 100% | 0% |

In case of the dimming signal D1 being 5.2 V (belonging to the range of 5.01 V to 5.5 V), the interpretation module 140 outputs, according to the comparison table T2, the first control signal $S_{231}$ representing 0% of 5.2V to the first light-emitting element 221, the second control signal $S_{232}$ representing 70% of 5.2 V to the second light-emitting element 222, the third control signal $S_{233}$ representing 0% of 5.2V to the third light-emitting element 223, and the fourth control signal $S_{234}$ representing 30% of 5.2V to the fourth light-emitting element 224. The first light-emitting element 221, the second light-emitting element 222, the third light-emitting element 223 and the fourth light-emitting element 224 emit light according to the first control signal $S_{231}$, the second control signal $S_{232}$, the third control signal $S_{233}$ and the fourth control signal $S_{234}$ respectively, and the emitting-light of the first light-emitting element 221, the emitting-light of the second light-emitting element 222, the emitting-light of the third light-emitting element 223 and the emitting-light of the fourth light-emitting element 224, or a mixed light of at least one of these emitting-light could conform to the current external environment state.

As shown in FIG. 2, the first light-emitting element 221, the second light-emitting element 222, the third light-emitting element 223 and the fourth light-emitting element 224 are, for example, light-emitting diodes, laser diodes or other suitable types luminous component. The first light-emitting element 221, the second light-emitting element 222, the third light-emitting element 223 and the fourth light-emitting element 224 are different in luminous properties. For example, the first light-emitting element 221 and the second light-emitting element 222 are different at least in light pattern, the third light-emitting element 223 and the fourth light-emitting element 224 are different at least in light pattern, and the first light-emitting element 221 and three light-emitting elements 223 are different at least color temperature. In an embodiment, the first light-emitting element 221 could provide a dry light pattern with high color temperature, the second light-emitting element 222 could provide a water-logging light pattern with high color temperature, the third light-emitting element 223 could provide a dry light pattern with low color temperature, and the fourth light-emitting element 224 could provide a water-logging light pattern with low color temperature. The aforementioned "high color temperature" ranges, for example, between 4,000 K and 10,000 K, and the aforementioned "low color temperature" ranges, for example, between 1,000 K to 4,000 K. The aforementioned "water-logging light pattern" is, for example, the light pattern suitable for water-logging environment (road surface), and the aforementioned "dry light pattern" is, for example, the light pattern suitable for a dry environment (road surface).

As shown in FIG. 2, the lamp device 100 further includes at least one lamp board, and each lamp board could carry at least one light-emitting element or at least two light-emitting elements having the same luminous property or different light-emitting properties. For example, the lamp device 100 further includes a first lamp board 220A, a second lamp board 220B, a third lamp board 220C, and a fourth lamp board 220D. At least one first light-emitting element 221 having the same luminous property could be disposed on the first lamp board 220A, at least one second light-emitting element 222 having the same luminous property could be disposed on the second lamp board 220B, at least one third light-emitting element 223 having the same luminous property could be disposed on the third lamp board 220C, and at least one fourth light-emitting element having same luminous property could be disposed on the fourth lamp board 220D. Each lamp board could be coupled to the corresponding current conversion module for being controlled by the corresponding current conversion module. For example, the first lamp board 220A is coupled to the first current conversion module 231, the second lamp board 220B is coupled to the second current conversion module 232, the third lamp board 220C is coupled to the third current conversion module 233, and the fourth lamp board 220C is coupled to the fourth current conversion module 234.

Each current conversion module outputs, according to the corresponding control signal, direct current to the corresponding lamp board, for controlling the light-emitting element disposed on the corresponding lamp board to emit light. For example, the first current conversion module 231 outputs, according to the first control signal $S_{231}$, the first direct current C1 to the first lamp board 220A to control the first light-emitting element 221 disposed on the first lamp board 220A to emit light, the second current conversion module 232 outputs, according to the second control signal $S_{232}$, the second direct current C2 to the second lamp board 220B to control the second light-emitting element 222 disposed on the second lamp board 220B to emit light, the third current conversion module 233 outputs, according to the second control signal $S_{232}$, the third direct current C3 to the third lamp board 220C to control the third light-emitting element 223 disposed on the third lamp board 220C to emit light, and the fourth current conversion module 234 outputs, according to the fourth control signal $S_{234}$, the fourth direct current C4 to the fourth lamp board 220D to control the fourth light-emitting element 224 disposed on the fourth lamp board 220D to emit light.

Figure 3:
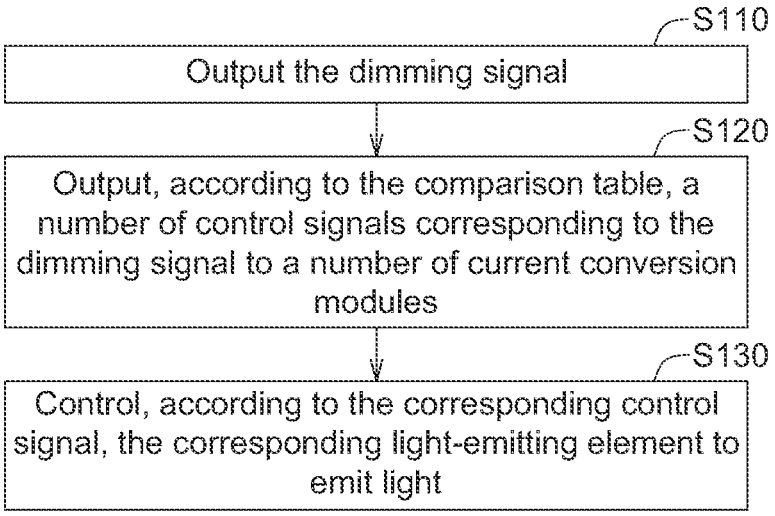
FIG. 3 shows a flowchart of the light-emitting control method of the lamp device of FIG. 1.

Referring to FIG. 3, FIG. 3 shows a flowchart of the light-emitting control method of the lamp device 100 of FIG. 1. FIG.

In step S110, the controller 110 outputs the dimming signal D1 to the interpretation module 140. For example, the controller 110 outputs the dimming signal D1 corresponding to the external environment state to the interpretation module 140, or outputs the dimming signal D1 to the interpretation module 140 according to the dimming command DT1.

In step S120, the interpretation module 140 outputs, according to the comparison table T1, a number of control signals corresponding to the dimming signal D1 to a number of current conversion modules, wherein the current conversion modules are coupled to a number of the light-emitting elements. For example, as shown in FIG. 1, the interpretation module 140 outputs, according to the comparison table T1, the first control signal $S_{131}$ and the second control signal $S_{132}$ corresponding to the dimming signal D1 to the first conversion module 131 and the second current conversion module 132 respectively.

As shown in FIG. 1, each current conversion module is coupled to the corresponding light-emitting element. For example, the first current conversion module 131 is coupled to the first light-emitting element 121, and the second current conversion module 132 is coupled to the second light-emitting element 122.

In step S130, each current conversion module controls, according to the corresponding control signal, the corresponding light-emitting element to emit light. For example, as shown in FIG. 1, the first current conversion module 131 controls, according to the first control signal $S_{131}$, the first light-emitting element 121 to emit light, and the second current conversion module 132 controls, according to the second control signal $S_{132}$, the second light-emitting element 122 to emit light. The emitting-light of the first light-emitting element 121, the emitting-light of the second light-emitting element 122 or the mixed light thereof could conform to the external environment state. As a result, through the combination of a number of the light-emitting elements having different light-emitting properties, a number of illuminations having a number of different light-emitting modes could be obtained, so as to respond to a variety of or changeable external environmental conditions.

The other steps of the light-emitting control method of the lamp device 100 have been described above, and the similarities will not be repeated here. In addition, the light-emitting control method of the lamp device 200 has steps similar to or the same as that of the light-emitting control method of the lamp device 100, and the similarities will not be repeated here.

To sum up, the embodiment of the present invention provides the lamp device and the light-emitting control method thereof, wherein the lamp device includes a number of the light-emitting elements having different luminous properties, and outputs, according to a comparison table, a number of the driving currents (for example, direct current) corresponding to the dimming signal to a number of the light-emitting elements respectively. Through the combination of a number of the light-emitting elements having different light-emitting properties, a number of illuminations having a number of different light-emitting modes could be obtained, so as to respond to a variety of or changeable external environmental conditions. In an embodiment, a number of the light-emitting elements could be disposed on at least one lamp board, wherein the light-emitting elements having the same luminous property or different luminous properties could be disposed on the same lamp board. The lamp device further includes a number of current conversion modules, wherein each lamp board could be coupled to the corresponding current conversion module, so that the light-emitting elements disposed on the same lamp board could be controlled by the corresponding current conversion module.

It will be apparent to those skilled in the art that various modifications and variations could be made to the disclosed embodiments. It is intended that the specification and examples be considered as exemplary only, with a true scope of the disclosure being indicated by the following claims and their equivalents.

What is claimed is:

1. A lamp device, comprises:

a controller configured to output a dimming signal;

a plurality of light-emitting elements;

a plurality of current conversion modules coupled to the light-emitting elements and configured to control the light-emitting elements to emit light;

an interpretation module coupled to the current conversion modules and configured to output, according to a comparison table, a plurality of control signals corresponding to the dimming signal to the current conversion modules respectively;

wherein the light-emitting elements are different in a luminous property, and one of the current conversion modules is configured to output a feedback signal to the controller.

2. The lamp device as claimed in claim 1, wherein each current conversion module is configured to output, according to the corresponding control signal, a direct current to the corresponding light-emitting element, and the direct current depends on the comparison table.

3. The lamp device according to claim 1, further comprises:

a power conversion module coupled to the current conversion modules and the interpretation module and configured to supplying power to the current conversion modules and the interpretation module.

4. The lamp device according to claim 1, wherein the controller is configured to:

determine whether the feedback signal is in an abnormal range; and generate an abnormal notification signal based on the feedback signal being in the abnormal range.

5. The lamp device according to claim 1, wherein the controller is coupled to a power supply, and the controller is configured to:

determine whether an alternating current provided by the power supply is in an abnormal range; and generate an abnormal notification signal based on the alternating current being in the abnormal range.

6. The lamp device according to claim 1, wherein the luminous property includes at least one of a color temperature and a light pattern.

7. The lamp device according to claim 1, further comprises a plurality of lamp boards, the light-emitting elements having the same luminous property are disposed on the same lamp board, each current conversion module is coupled to the corresponding lamp board, each current conversion module is configured to output a direct current to the corresponding lamp board according to the corresponding control signal for controlling the light-emitting element disposed on the corresponding lamp board to emit light.

8. A light-emitting control method for a lamp device, comprises:

outputting a dimming signal by a controller;

outputting, according to a comparison table, a plurality of control signals corresponding to the dimming signal to the current conversion modules respectively by an interpretation module;

controlling corresponding light-emitting elements to emit light according to the corresponding control signal by each current conversion module; and outputting a feedback signal to the controller by one of the current conversion modules, wherein the light-emitting elements are different in a luminous property.

9. The light-emitting control method according to claim 8, further comprises:

outputting, according to the corresponding control signal, a direct current to the corresponding light-emitting element by each current conversion module, wherein the direct current depends on the comparison table.

10. The light-emitting control method according to claim 8, further comprises:

supplying power to the current conversion modules and the interpretation module by a power conversion module.

11. The light-emitting control method according to claim 8, further comprises:

determining whether the feedback signal is in an abnormal range; and generating an abnormal notification signal based on the feedback signal being in the abnormal range.

12. The light-emitting control method of claim 8, wherein the controller is coupled to a power supply, and the light-emitting control method further comprises:

determining whether an alternating current provided by the power supply is in an abnormal range by the controller; and generating an abnormal notification signal by the controller based on the alternating current being in the abnormal range.

13. The light-emitting control method according to claim 8, wherein the luminous property includes at least one of a color temperature and a light pattern.

14. The light-emitting control method according to claim 8, wherein the light-emitting elements having the same luminous property are disposed on the same lamp board, each current conversion module is coupled to the corresponding lamp board; the light-emitting control method further comprises:

outputting a direct current to the corresponding lamp board according to the corresponding control signal by each current conversion module for controlling the light-emitting element disposed on the corresponding lamp board to emit light.

* * * * *